United States Patent [19]

Lohr

[11] 4,198,046

[45] Apr. 15, 1980

[54] TARGET GAME WITH MOVING INDICATOR

[76] Inventor: Raymond J. Lohr, 5043 Sterrettania Rd., Erie, Pa. 16506

[21] Appl. No.: 874,228

[22] Filed: Feb. 1, 1978

[51] Int. Cl.[2] ..... A63B 71/04; F41F 27/00

[52] U.S. Cl. ..... 273/315

[58] Field of Search ..... 273/101.2, 105.2, 1 R, 273/1 E, 101.1, 102.1 E

[56] References Cited

U.S. PATENT DOCUMENTS

| | | | |
|---|---|---|---|
| 12,916 | 2/1909 | Fiske | 273/101.2 |
| 2,061,092 | 11/1936 | Squire | 273/101.1 |
| 2,070,529 | 2/1937 | Falkenberg | 273/101.1 |
| 2,280,623 | 4/1942 | Broomfield | 273/105.2 |
| 2,707,634 | 5/1955 | Johnson | 273/1 R |
| 2,905,468 | 9/1959 | Ellman | 273/101.2 |
| 2,934,634 | 4/1960 | Hellberg | 273/101.1 |
| 3,112,929 | 12/1963 | Gisser | 272/31 R |

FOREIGN PATENT DOCUMENTS

| | | | |
|---|---|---|---|
| 2707055 | 8/1977 | Fed. Rep. of Germany | 273/101.1 |
| 1352442 | 1/1964 | France | 273/101.2 |

*Primary Examiner*—Richard C. Pinkham
*Assistant Examiner*—Lawrence E. Anderson
*Attorney, Agent, or Firm*—Charles L. Lovercheck

[57] ABSTRACT

A combination gun and target which provide a safe target game that fires no missile, but appears to knock over the targets by direct hits as a result of good aiming and proper timing. The gun has an improved switching mechanism, and the target assembly includes a kicking device to knock down the targets and an indicating device, which indicates when the target kicking device and indicating device are aligned so that when the trigger of the gun is pulled at the instant the indicating device is aligned with the target, the kicking device will knock the target over.

20 Claims, 7 Drawing Figures

TARGET GAME WITH MOVING INDICATOR

GENERAL STATEMENT OF THE INVENTION

The target game disclosed herein incorporates a target assembly wherein the targets may be knocked over one by one when the trigger of the gun is pulled at the proper time, that is, during the time that a visual indicator shows that a kicking device is aligned with a particular target. Thus, by aiming the gun at a particular target and pressing the trigger at the time when the indicator gun and target are aligned with each other, the actuating mechanism for the particular target will be aligned with the impelling mechanism knocking over the particular target and giving the appearance that a missile from the gun has made a direct hit on that target, even though the only connection between the gun and the target is an electrical wire with a switch on the gun trigger.

OBJECTS OF THE INVENTION

It is an object of the invention to provide a safe target game that knocks over targets by triggering the gun when an indicator is aligned with the target when the gun is properly aimed and the trigger pulled at the proper time, yet the gun fires no missile.

Another object of the invention is to provide an improved target game.

Another object of the invention is to provide an improved target arrangement kicking device and indicator in a target game.

Still another object of the invention is to provide an improved gun in combination with a target game.

Yet another object of the invention is to provide an improved target apparatus for a target game.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
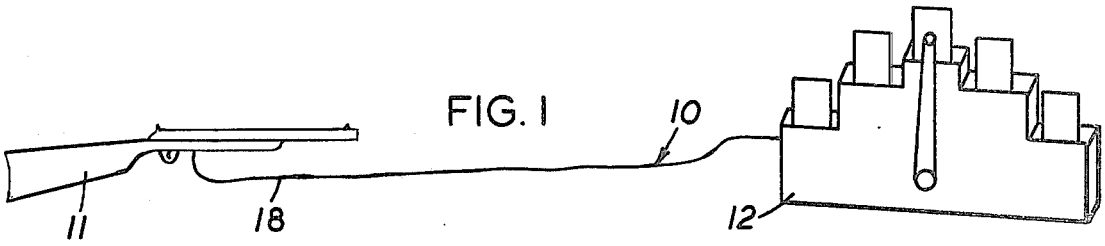
FIG. 1 is a view of the target and gun connected to the target assembly according to the invention.
Figure 2:
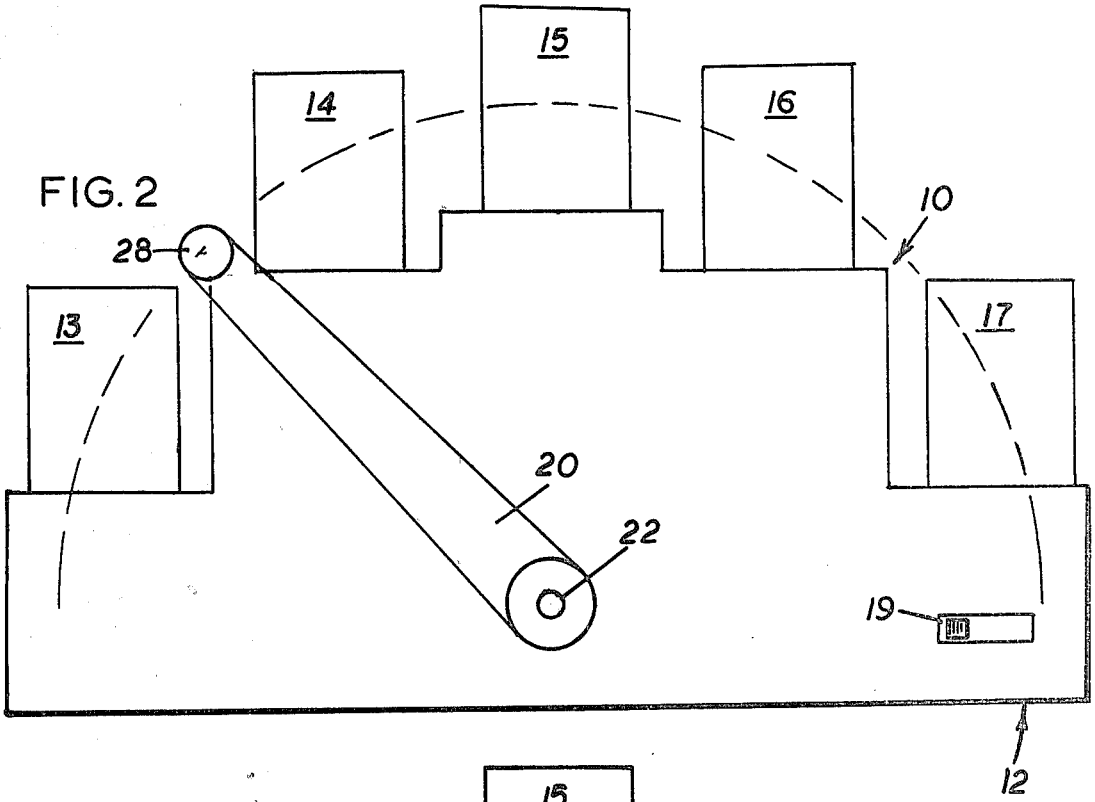
FIG. 2 is a front view of the target, supporting frame and targets supported thereon.
Figure 3:
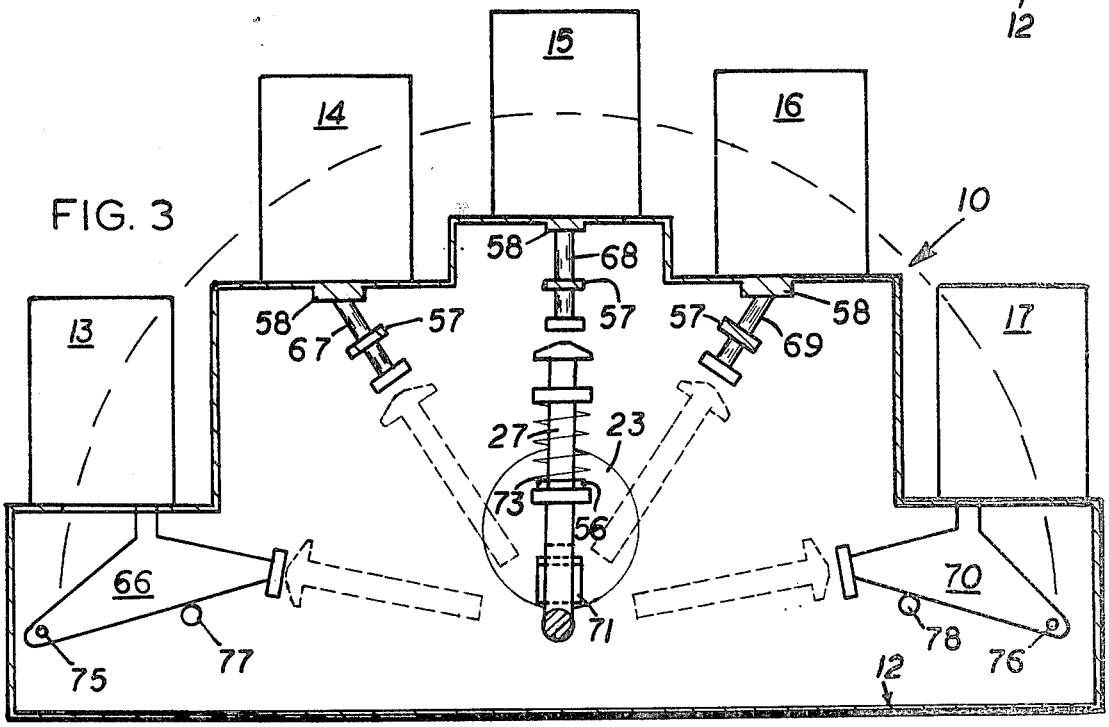
FIG. 3 is a cross-sectional view taken on Line 3—3 of FIG. 4.

Now, with more particular reference to the drawings, the target game is generally indicated at 10 and is made up of a gun 11 and a target support frame 12, which may support a plurality of targets 13, 14, 15, 16 and 17.

The targets 13, 14, 15, 16 and 17 are supported on the target support frame 12 by a suitable connection, so that they can move from an erect position 64 to a down position 65. In the example shown, the targets are pivoted to the target support frame by pivots 62 and swing from the erect position 64 to the down position 65 when they are engaged by the upper end of push rods 66, 67, 68, 69 and 70 of the target actuating mechanism. The push rods are engaged by the impelling rod 27, which is slidably mounted on the cradle 72. The target actuating means includes the bell crank 71 that is pivoted to the cradle 72, the impelling rod 27 and the push rods 66 through 70, together with the solenoid 23. Solenoid 23 has a reciprocating rod 63 which reciprocates when the solenoid coil is energized. When the rod 63 reciprocates, it moves outwardly engaging the bell crank 71 and swings the bell crank 71 about its pivot. When the bell crank 71 swings about its pivot, it engages the lower end of the impelling rod 27 and lifts the rod 27.

The indicating bar 20 has the indicator 28 fixed to an end and the other end is fixed to the indicator support frame 21. The frame 21 is rocked backward and forward, thus swinging the indicator bar 20 back and forth across the face of the target support frame through an arc of approximately 180° and carrying the indicator 28 successively into alignment with the targets 13, 14, 15, 16 and 17.

Solenoid 23 is supported on the cradle 72, a depressed portion of the indicator support 72. The solenoid 23 rocks about the axis of shaft 21 that is supported in bearings in the vertical member of the target support frame 12 and the motor 24.

Any other suitable means could be employed to visually indicate when the impelling rod is aligned with one of the push rods.

The bell crank 71 is pivoted to the bracket 52 which is, in turn, supported on the cradle 72 of the indicator support frame 21. The indicator support frame 21 has a vertical member 53 which has the spaced brackets 54 and 55 fixed thereto. These brackets are bored vertically and slidably recieve the impellng rod 27. The impelling rod 27 has a compression spring 73 thereon that is supported against the upper bracket 54 and against the pin 56, which passes through the impelling rod 27 and is stopped against the lower bracket 55 limiting the downward motion of impelling rod 27. The push rods 67, 68 and 69 are slidably received in brackets 57 and 58 on the target support frame 12. The push rods 66 and 70 are pivoted at pivots 75 and 76 and rest on pins 77 and 78. When the push rods 66 and 70 are impacted by the impelling rod 27, they rotate on their pivot points 75 and 76 swinging their upper ends 79 and 80 upward to strike and knock over the targets 13 and 17.

Figure 4:
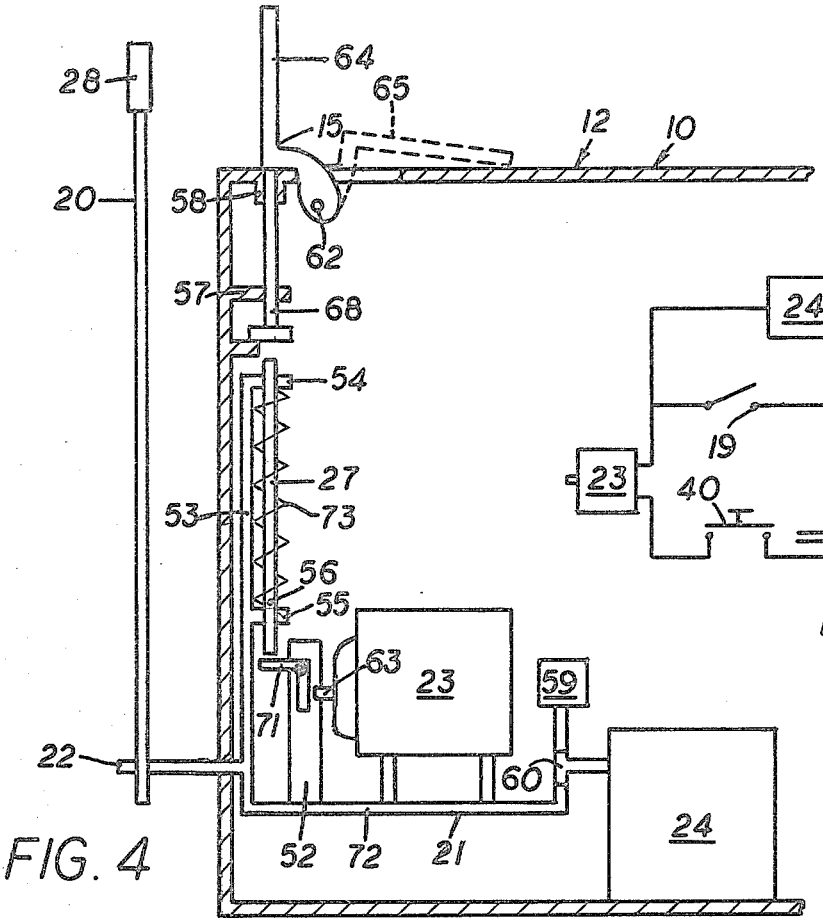
FIG. 4 is a side view of the actuating mechanism with the side of the cover removed.
Figure 7:
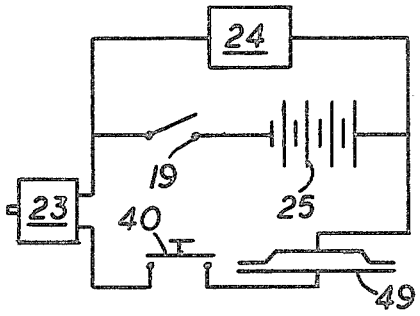
FIG. 7 is a schematic wiring diagram of the gun and target.

The indicator support frame could be oscillated by any suitable oscillating means; however, in the example shown in FIG. 4, it is oscillated by the motor 24. The motor 24 has a rack 59 with a gear 60 on it. The gear 60 engages the rack for oscillating the indicator support frame 21 about the axle 22 thereby rocking the indicator arm 20 and moving the indicator 28 successively in front of the targets 13, 14, 15, 16 and 17 as it passes through an arc of approximately 180°.

When the solenoid 23 is activated, the reciprocating rod 63 is forced against the bell crank 71, which engages the impelling rod 27 moving it upwardly. If a push rod 66 through 70 is aligned with the impelling rod, the impelling rod will force the push rod upwardly, which will strike the particular target 13 through 17 rotating that target about its pivot 62 from the erect position 64 shown in full lines in FIG. 4, to the down position 65 shown in phantom lines. Any suitable means for moving the push rods 66 through 70 up and down could be provided.

The gun 11 contains the firing switch 49 and the safety switch 40. The firing switch 49 has a link 29 which has the pin 31 fixed to it. Pin 31 extends from each side of the link 29 and one end slides in a slot 32 in a wall of the gun. The end of the pin 31 acts as a detent, which engages the movable part 34 of the switch 49 so that when the link 29 is sliding from the cocked position 29', shown in dotted lines in FIG. 5, to the uncocked position, shown in full lines, the movable contacts 35 and 36 are held in contact with the brass contact bar 33. Pin 37 is fixed to the side of the gun and cocking member 48 is fixed to cocking lever 46 and lever 46 is pivoted to the gun at 47. Pin 74 extends laterally from link 48 and engages the sear hook 38 on link 29 when the lever 46 is swung from the position shown in FIG. 5 in full lines to the position shown in FIG. 5.

The normally open safety switch 40 has a fixed part 42 and a movable part 41 that are held closed by the lever 46. When the firing mechanism is being set, the switch 40 is opened while the lever 46 is being moved to shift the link 29 to the cocked position. When the switch 40 is closed, a circuit is completed by the firing switch 49, which will activate the solenoid 23 on the target frame 10.

When the lever 46 is swung down away from the gun about the pivot 47 to cock the gun, the link 48 moves away from the movable part 41 of the switch 40 opening it so that the gun cannot be fired while the lever 46 is being cocked.

Figure 5:
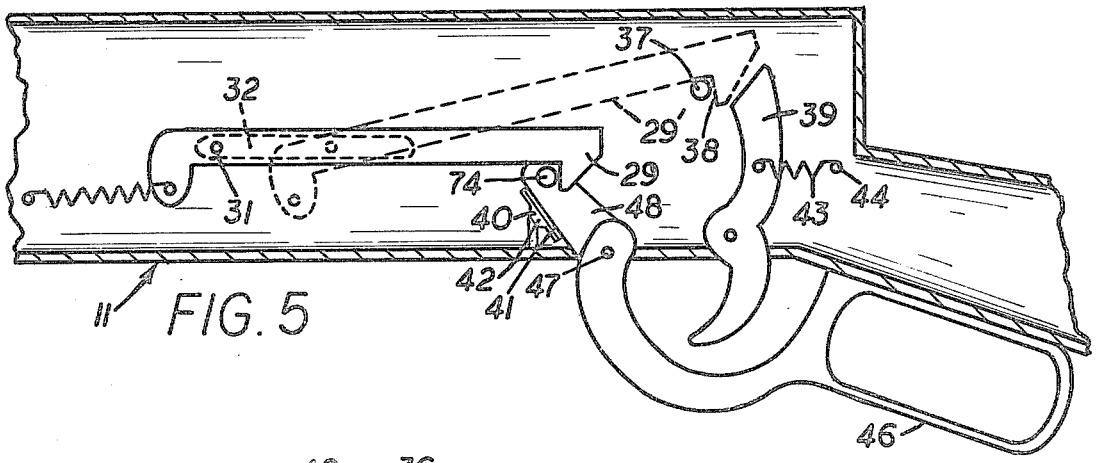
FIG. 5 is a partial schematic side view of the gun showing its cocking mechanism.
Figure 6:
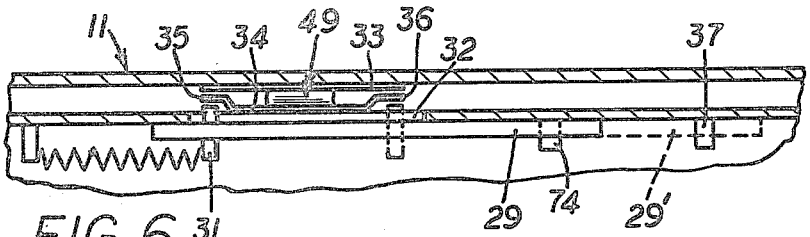
FIG. 6 is a partial top view of the cocking mechanism shown in FIG. 5.

Thus, when the lever 46 is swung from the position shown in FIG. 5 to the open position, the link 29 is moved from the full line position in FIG. 5 to the dotted line position shown in FIG. 5. While the lever 46 is not in the fully closed position, the safety switch 40 will be open, and the solenoid cannot be activated during the cocking of the gun.

The foregoing specification sets forth the invention in its preferred, practical forms, but the structure shown is capable of modification within a range of equivalents without departing from the invention, which is to be understood is broadly novel as is commensurate with the appended claims.

The embodiments of the invention in which an exclusive property or privilege is claimed are defined as follows:

1. A target game made up of a gun and a target support frame (12), a target (13) supported on said target support frame (12) movable from an erect position to a knocked-down position, a target impact means 68 supported on said frame, an indicator support frame (21) on said target support frame and rotatable about a generally horizontal axis, an indicator (23) supported on said indicator support frame (21) and adapted to swing with said indicator support frame (21) from a position remote from said target to a position in alignment with said target, a target impellng means (27) supported on said indicator support frame, a gun (11) adapted to be aimed at the target by an operator, said gun having a trigger means (18), moving means attached to said indicator support frame (21) and adapted to move said indicator (27) from a position in the line of sight of said gun between said gun and said target to a position remote from said target, said impellng means (27) supported on said indicator support frame (21) being movable with said indicator support frame (21) to impact said target impellng means (27) when said indicator (28) is aligned with said target (13), an electrical means connecting said trigger means (19) to said impelling means for impacting and moving said target impelling means (27) when said trigger is actuated and said target impellng means is aligned with said impact means at the proper time whereby said target is knocked over.

2. The combination recited in claim 1 wherein said impelling means comprises a solenoid having a core adapted to be thrust against said target impelling means when said trigger is actuated.

3. The combination recited in claim 1 wherein said gun comprises a link, said link has a hook on the end thereof remote from a pin in said link and the second pin fixed to the gun and extending therefrom, a cocking lever swinging the support on a gun body, said cocking lever having a laterally extending pin thereon, said laterally extending pin being adapted to engage said hook on said link swinging said link from a position against the force of a return spring connected to the said link to a cocked position.

4. The target game recited in claim 1 wherein said trigger means comprises, time delay means holding a switch in closed position for a predetermined time after said gun is actuated, said switch being connected to target impelling means on said target support frame.

5. The combination recited in claim 1 wherein said gun has a time delay mechanism whereby a switch is held in closed position for a predetermined time when said trigger is pulled.

6. The combination recited in claim 5 wherein said time delay mechanism comprises, a link and pin on said link slidably engaging a slot in said gun, spring means causing said link to slide to a second position, and means on said link engaging said switch holding said switch in closed position during the time said link slides from a first position to a second position.

7. The combination recited in claim 6 wherein said link has a hook thereon, said combination further comprising, a pin supported on said gun, and said hook being adapted to engage said pin on said gun when in a cocked position, said trigger having a means thereon to push said hook off of said pin on said gun when said trigger is pulled.

8. The combination recited in claim 7 wherein means is provided to move said link to a cocked position, means for releasing said link when said trigger engages said means moving said link from a starting position to a stop position, said switch means being connected to a solenoid means along said target support frame.

9. The combination recited in claim 8 wherein said link engages said switch during the movement of said link from said starting position to said stopping position whereby said solenoid is held in an actuated position during the time said link moves from said stopping position to starting position when said trigger is pulled.

10. The target game recited in claim 1 wherein said indicator comprises a bar swingably supported on said support frame, said bar on its distal end overlies said target when said indicator is swung past said target.

11. The target game recited in claim 1 wherein a plurality of said targets are supported on said target support frame, said targets being spaced from each other and each of said targets being movable from an erect position to a knocked-down position.

12. The combination recited in claim 1 wherein said connecting means comprises at least one electrical wire connecting said trigger means to said impelling means.

13. The combination recited in claim 11 wherein said targets are swingably supported on said target support frame to swing from said erect position to said knocked-down position.

14. The target game recited in claim 13 wherein said impelling means is supported on said indicator support frame which is supported on said target support frame and pivoted to swing on an axis thereon, and said indicator is fixed to said indicator support frame and swingable about said axis.

15. The target game recited in claim 14 wherein said impelling means includes a solenoid supported on said indicator support frame, said solenoid having a core adapted to impact said target impact means once said trigger is pulled.

16. The target game recited in claim 15 wherein said axis of said indicator support frame has motor means connected thereto for swinging said indicator support frame relative to said target support frame whereby said indicator is swung about said axis.

17. The target game recited in claim 16 wherein said motor means comprises an electric motor and a rack and pinion set connecting said motor to said indicator support frame whereby said frame is swung about said axis when said motor moves said rack.

18. The target game recited in claim 16 wherein said impact means for said target comprises, a plurality of push rods, each said push rod being slidably supported on said target support frame, each said push rod having one end adapted to engage said target and the other end adapted to be engaged by said impelling means.

19. The target game recited in claim 18 wherein said impelling means comprises, an impelling rod slidably supported on said indicator support frame, a bell crank supported on said indicator support frame adapted to be engaged by said solenoid core whereby said impelling rod engages the particular said push rod.

20. A target game made up of a gun and a target support frame, a target supported on said target support frame and movable from an erect position to a knock-down position, a target impact means on said frame, an indicator supported on said target support frame, and moving means for moving said indicator from a position between said gun and said target to a position remote from said target, impelling means movably supported on said target support frame and movable with said indicator means to impact said target impact means when said indicator is aligned with said target, trigger means on said gun, an electrical means connecting said trigger means to said impelling means for impelling said target impact means when said trigger is actuated and said target impact means is aligned with said impelling means at the proper time, a plurality of said targets being swingably supported on said target support frame to swing from said erect position to said knock-down position, said impelling means comprising an indicator support frame supported on said target support frame and pivoted to swing on an axis thereon, and said indicator being fixed to said indicator support frame and swingable about said axis, said impelling means including a solenoid supported on said indicator support frame, said solenoid having a core adapted to impact said target impelling means once the trigger is pulled, said axis of said indicator support frame having a motor means connected thereto for swinging said indicator support means relative to said target support frame, whereby said indicator is swung about said axis, said impact means for said target comprising a plurality of push rods, each said push rod being slidably supported on said trigger support frame, each said push rod having one end adapted to engage said target and the other end adapted to engage said impelling means, said push rods being arranged on lines corresponding to radii of a circle having a center on the axis of rotation of said indicator support frame.

* * * * *